US006791269B1

(12) United States Patent
Popov

(10) Patent No.: US 6,791,269 B1
(45) Date of Patent: Sep. 14, 2004

(54) ACTIVE PHOTOMULTIPLIER TUBE BASE

(75) Inventor: Vladimir E. Popov, Newport News, VA (US)

(73) Assignee: Southeastern Universities Research Assn., Inc., Newport News, VA (US)

( * ) Notice: Subject to any disclaimer, the term of this patent is extended or adjusted under 35 U.S.C. 154(b) by 491 days.

(21) Appl. No.: 09/774,735

(22) Filed: Jan. 31, 2001

(51) Int. Cl.[7] ..... H01J 29/41; H01J 43/04
(52) U.S. Cl. ..... 315/12.1; 313/532
(58) Field of Search ..... 315/12.1, 383; 313/533, 535, 532; 250/207, 214 AG, 214 VT

(56) References Cited

U.S. PATENT DOCUMENTS 5,367,222 A * 11/1994 Binkley ..... 315/12.1
5,512,755 A * 4/1996 Vickers et al. ..... 250/363.09
5,525,794 A * 6/1996 Gibbons ..... 250/207
5,736,731 A * 4/1998 Kyushima et al. ..... 250/207
5,864,141 A 1/1999 Majewski et al. ..... 250/363.02
5,880,457 A * 3/1999 Tomiyama et al. ..... 250/207
6,121,619 A * 9/2000 Johnsen et al. ..... 250/369

* cited by examiner

*Primary Examiner*—Tan Ho
*Assistant Examiner*—Minh Dieu A

(57) ABSTRACT

A Photo-Multiplier Tube (PMT) base for supplying long-term stable power, gain control and output amplification to a PMT. The present PMT base integrates the circuitry required for the dynode stages of the PMT with an amplifying circuit that amplifies the PMT output signals without disturbing the stable power that is required by each of the dynode stages. In operation the PMT base is electrically and mechanically connected to a PMT. The circuits for the dynode stages primarily provide gain control for each dynode stage in the PMT. The amplifying circuit in the PMT base is electrically connected to a dynode, the anode or both a dynode and the anode of the PMT, from which the PMT output signal is received. A PMT high voltage divider supplies the power to the circuitry required for the dynode stages and the amplifying circuit in the PMT base. The PMT base can be replaceable and can replace PMT bases that do not have an integrated amplifier for the PMT output signal. The present PMT base extends the life of PMT's by reducing the currents consumed by the dynodes in the PMT.

13 Claims, 7 Drawing Sheets

PRIOR ART

ACTIVE PHOTOMULTIPLIER TUBE BASE

BACKGROUND OF THE INVENTION

The present invention relates to photons detectors, radiation detectors, scintillation counters, gamma cameras and more particularly to photomultiplier tube bases that are used in such cameras and detectors.

A photomultiplier tube (PMT) is a photosensitive device that converts light photons into a electrical current. The main components of a PMT are an input window, a photocathode, focusing electrodes, dynodes and an anode (output). The photocathode is used for converting incoming light (photons) into electrons. These photoelectrons, which are a product of photoelectric effect, are directed by the potential of focusing electrodes towards dynodes. The dynodes are used to multiply the electrons by the process of secondary electron emission. Electron gains of $10^3$ to $10^8$ are common and depend on the number of dynodes and inter-dynode potentials. Dynodes are made or covered with a layer of secondary emissive material. The condition of the dynode surfaces are responsible for PMT stable gain performance. All known dynode emissive materials are sensitive to electron stress. The most sensitive dynodes are those that are at the end of the series of dynodes, where the quantity of secondary electrons emitted is the largest. Understandably, for long-term, stable operation of a PMT, a low anode currents is preferable.

The voltages that create the electrostatic fields between the photocathode, the focusing electrodes and the dynodes are delivered from a single high-voltage stable power supply and a voltage divider. The divider is a common part of a PMT base. The design of the divider circuit is crucial to getting the best performance from PMT. There are many versions of PMT high voltage dividers optimized or designed for some particular application. Most of them are concentrated on specific parameters that are critical for a given application, such as maximum gain, dynamic range, low noise, or linearity.

Series-regulator type high voltage power supplies optimized for photomultiplier tubes are well known in the art and have gained a good reputation. Other components found in or required by scintillation cameras are described in "Photomultiplier Tube, Principle to Application" by Hamamatsu Photonics K. K., March 1994, which is incorporated herein by reference.

The output of a photomultiplier tube is a current (charge), while the external signal processing circuits are usually designed to handle a voltage signal. Therefore, the current output must be converted into a voltage signal by a current to voltage converter. Further, the current that is output from a PMT anode is very small, especially in low light level detection, low gain PMT's, and photon counting applications. An operational amplifier can be used to both convert the anode output current to a voltage and accurately amplify the resulting voltage. Typically this operational amplifier is powered by a source that is separate from the high voltage power source for the dynode stages of the PMT. This is done to insure the stability of the power supply to the dynodes. The voltage supplied to each dynode stage must be extremely stable or the PMT output will be adversely affected. Prior PMT bases contained only components for the dynode stages of the PMT. It was thought that by keeping the PMT base simple, it would be easier to maintain stable power.

U.S. Pat. No. 5,864,141 entitled, "Compact, high-resolution, gamma ray imaging for scintimammography and other medical diagnostic applications" discloses a typical PMT system wherein the amplifier of the PMT output signal is powered by a power source that is external to the PMT system and PMT high voltage divider.

U.S. Pat. No. 5,525,794 entitled, "Electronic gain control for photomultiplier used in gamma camera" discloses active components that are powered by the PMT power source, however, these active components only provide gain control for the dynode stages and do not amplify the PMT output signal.

U.S. Pat. No. 5,367,222 entitled, "Remote gain control circuit for photomultiplier tubes" is similar to the '794 Patent above. Both Patents disclose the PMT high voltage divider powering only active components for gain control. All active components, in both Patents, for amplifying the PMT output signal are powered by an external power source.

The present invention provides a PMT base with an active component that is not used for high voltage stability but rather for PMT output pulse amplification, pulse shaping and device impedance conversion. In the preferred embodiment an amplifier is integrated into and powered by the PMT high voltage divider circuit. This allows an improved signal to noise ratio and reduces PMT anode current there by providing better long-term stability when compared to prior PMT bases. The amplifier also provides improved pulse shaping for better signal transmission through long external cable lines. The present PMT base also minimizes the power cables that are required by the system. Further, and perhaps most importantly, the power supply to the dynode stages of the PMT remains stable, in the present PMT base.

Typically, a PMT provides reliable, stable gain for some hundreds or thousands of hours, then its stability decreases as a function of the total charge handled. The decreased stability is primarily a result of dynode degradation. The dynode stages of a PMT are worn down more quickly when higher voltages, higher gain and higher anode currents are used. The use of very high voltages across the dynode stages provides a PMT output that may not need amplification. However, this leads to frequent replacement of the PMT's. Systems, like those mentioned in the patents above, use relatively low voltages between the dynode stages but then send the PMT output to a circuit that is external to the PMT for amplification. These systems have poor signal to noise ratios and have higher overall power consumption, when compared to the present system. By integrating the PMT output amplifier with the circuits that control the dynode stages, all of which are powered by the PMT high voltage divider, a PMT base is created that extends the life of the PMT and allows easy replacement of current PMT bases of scintillation cameras, gamma cameras and other radiation detectors without the need to worry about a second power supply for amplifying the PMT output.

SUMMARY OF THE INVENTION

The present innovative concept provides a PMT base with long-term stability, improved signal to noise ratios and proper long line termination without the need of an external amplifier for a PMT output signal. An amplifier for the PMT output is integrated with the circuits for the dynode stages in a way that keeps the power supply stable for the voltage sensitive dynodes. The PMT high voltage divider provides power sequentially to each dynode stage circuit and then to the PMT output amplification circuit. The PMT output signal from an anode, the last dynode, or both, provides the input for the present amplification circuit. The dynode circuits and the output amplification circuit are integrated into one unit that receives power from the PMT high voltage divider and produces an amplified PMT output signal without disrupting the stability of the power provided to the dynode stages. The amplification circuit may comprise any suitable component or components for amplifying the PMT output, such as a one stage or multistage transistor and/or resistor circuit, for example.

BRIEF DESCRIPTION OF THE DRAWINGS

The invention of the present application will now be described in more detail with reference to the preferred embodiment of the method and apparatus, given only by way of example, and with reference to the accompanying drawings, in which.

DETAILED DESCRIPTION OF THE INVENTION

Gamma rays, x-rays and other ionization radiation can be detected using a scintillator material coupled to a photomultiplier tube. Scintillator materials have intrinsic energy resolution capabilities that are dependent upon the conversion efficiency of the scintillator material and are also a function of energy of emitted photons. The photons are detected by first converting them to photoelectrons. As the electrons pass through the scintillator material some or all of its energy is converted to scintillation optical photons. Different photons will travel at different distances in a crystal before depositing their energy thus giving rise to scintillation light. Scintillators are used in compact medical cameras. With the same success a PMT may be used for detection of any low light sources like Cherenkov radiation or from cosmic objects.

Figure 1:
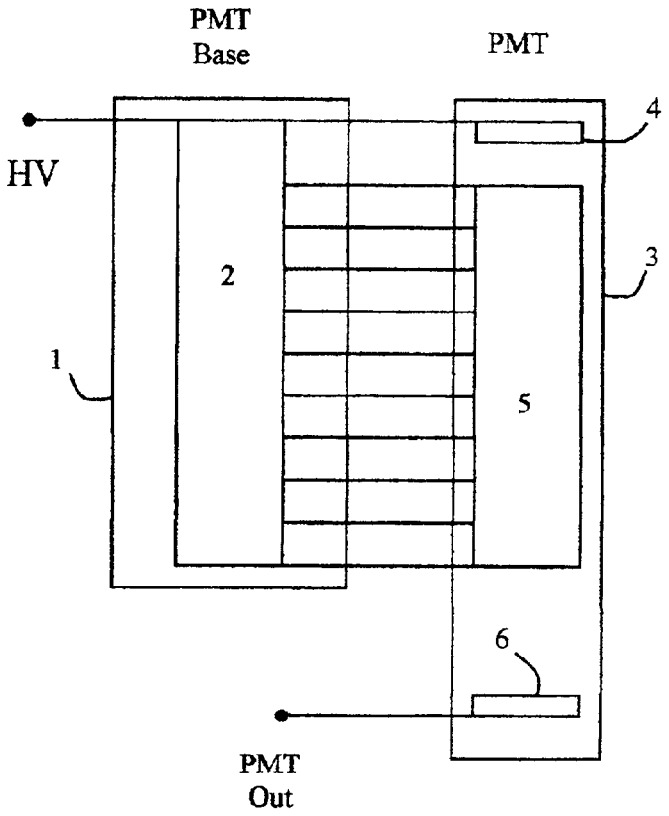
FIG. 1 is a schematic of a prior art PMT Base to PMT connection.

FIG. 1 illustrates the general electrical connection in a prior art PMT Base and PMT combination. The high voltage source HV supplies power to PMT Base 1 and cathode 4 of PMT 3. PMT Base 1 has electronic circuitry 2 that is associated with the dynode stages 5 of the PMT 3. Electronic circuitry 2 provides stability of the power source HV, which is crucial in PMT applications, and also provides gain control for each of the dynode stages 5. As described above, in PMT 3 electrons are emitted from cathode 4 and are multiplied through the each of the dynode stages 5. The multiplied electrons emitted from the last dynode stage are collected by anode 6 and then output as PMT Out. In the prior art, PMT Out is sent to an external amplifier for amplification of the signal before the signal is ultimately displayed. This was done to preserve the stability of the high voltage power source HV.

Figure 2:
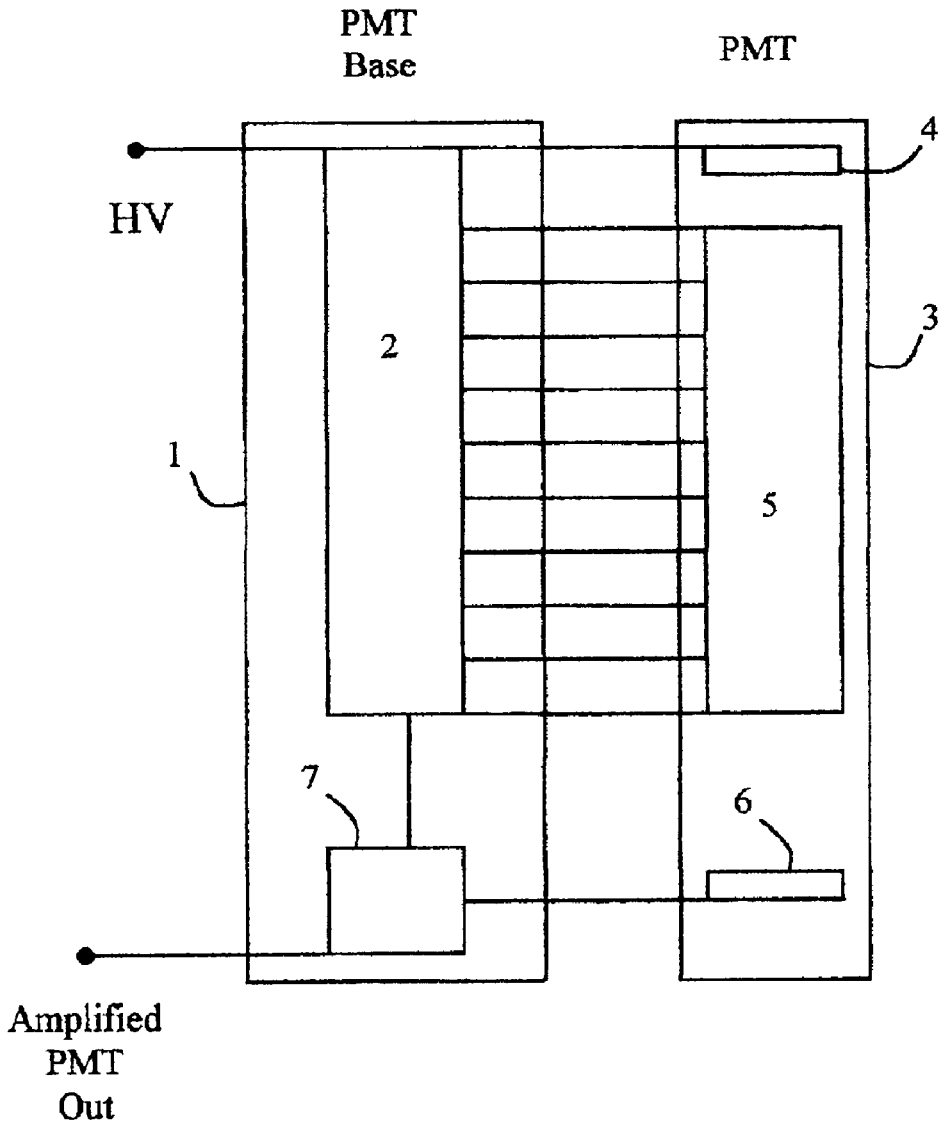
FIG. 2 is a schematic of an embodiment of the present invention.

FIG. 2 is a general schematic of an embodiment of the present invention wherein like parts as in FIG. 1 have like reference numbers. Amplifying circuit 7 is electrically connected to anode 6 and receives PMT Out from anode 6. Amplifying circuit 7 is also electrically connected to and powered by high voltage power source HV. After receiving PMT Out from anode 6, amplifying circuit 7 processes the signal and outputs Amplified PMT Out, which is then used for display or other diagnostic purposes. Amplifying circuit 7 is integrated with circuitry 2, within PMT Base 1. Examples of specific circuits that may be used in electronic circuitry 2 and in amplifier circuit 7 are discussed below.

Figure 3:
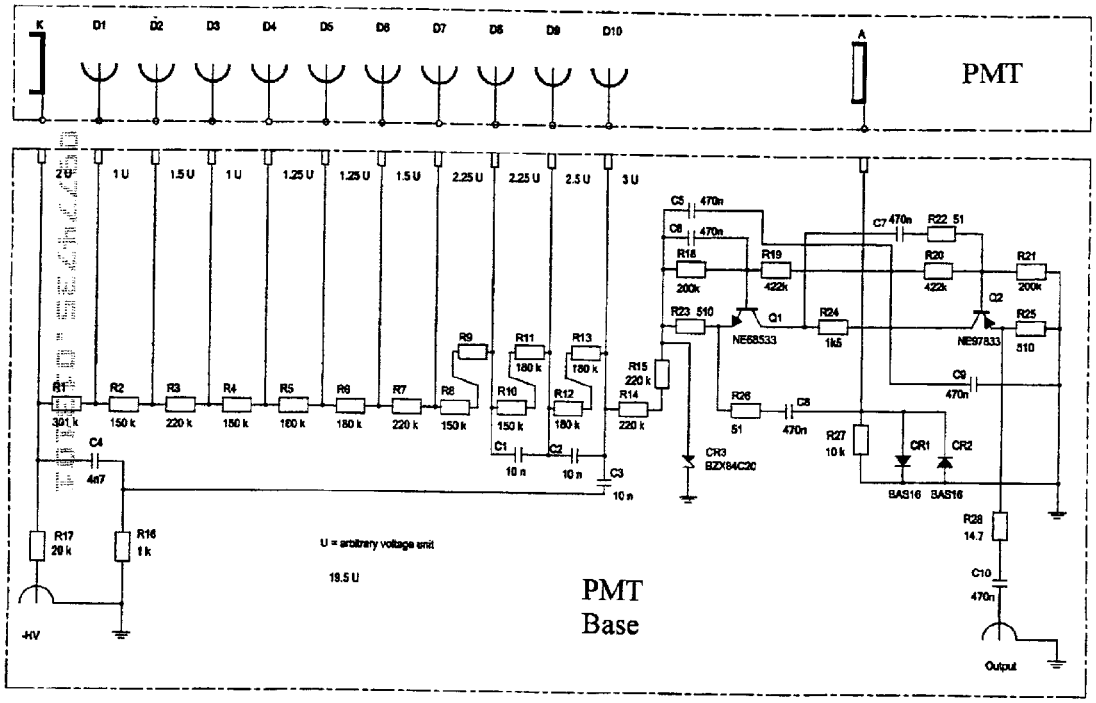
FIG. 3 is an electrical diagram of an embodiment of the present invention and a PMT.

FIG. 3 shows specific components within an embodiment of the present invention and their associated connections with a PMT. In the PMT Base, the amplifying circuit is comprised of: transistors Q1 and Q2; diodes CR1–CR3; resistors R14, R15 and R18–R28; and capacitors C5–C10. The remaining circuitry in the PMT Base is for gain control of the dynode stages of the PMT. The Output shown in FIG. 3 is the amplified PMT output signal. A generic PMT with cathode K, ten dynode stages D1–D10, and anode A, is also shown in FIG. 3 for reference purposes.

Figure 4:
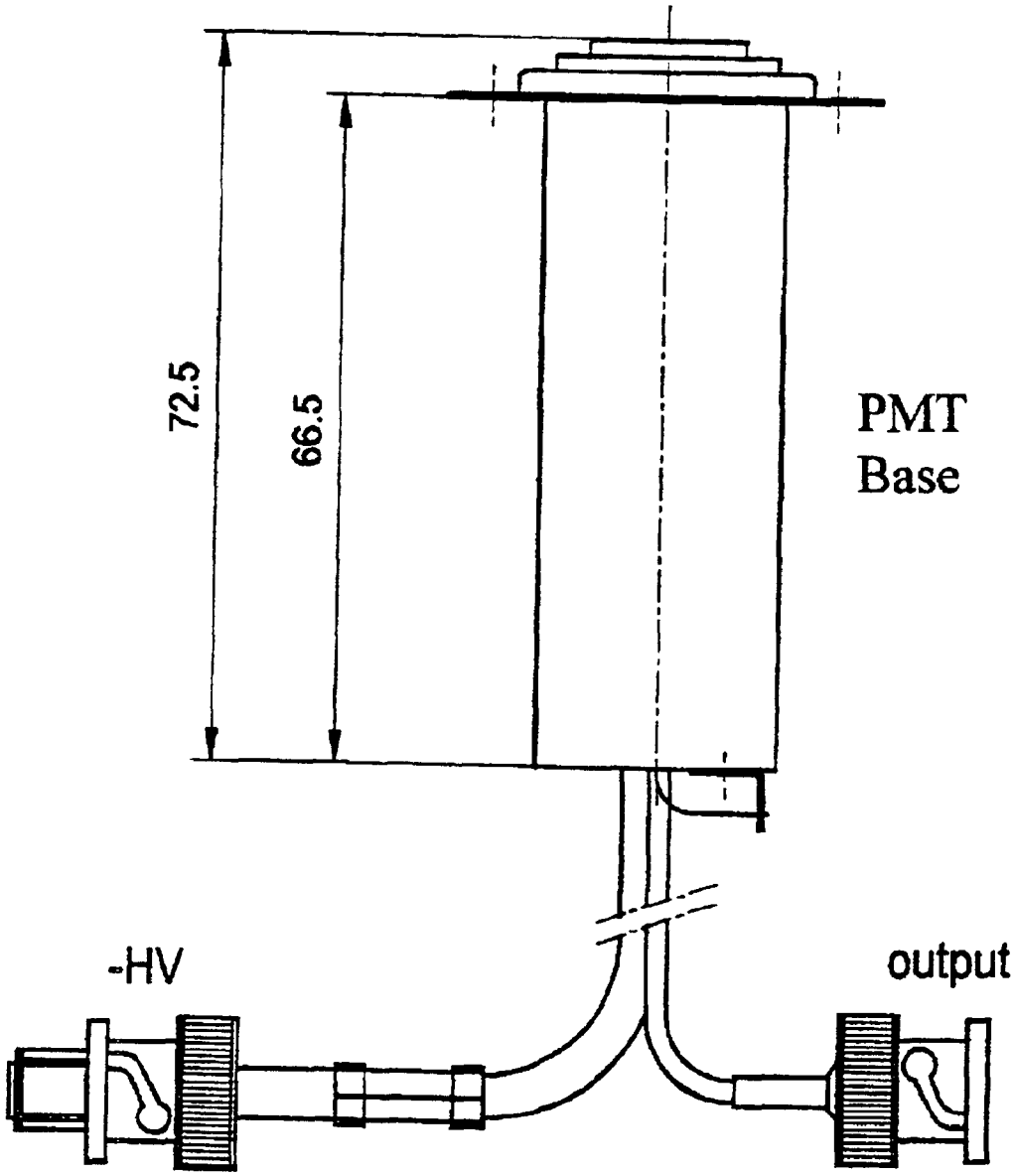
FIG. 4 is diagram of a physical embodiment of the present PMT Base.

FIG. 4 shows a physical embodiment of the PMT Base of FIG. 3, with –HV being the input from a high voltage power source and "output" being the amplified PMT output signal. All of the components in the PMT Base in FIG. 3 are enclosed in the physical embodiment of FIG. 4. The PMT Base has all of its electrical connectors, for connection to a PMT, on the end of the cylindrical device that is opposite of the –HV and "output" cables. The measurements provided in FIG. 4 are in millimeters (mm) however, the present PMT base may take other sizes as well.

Figure 5:
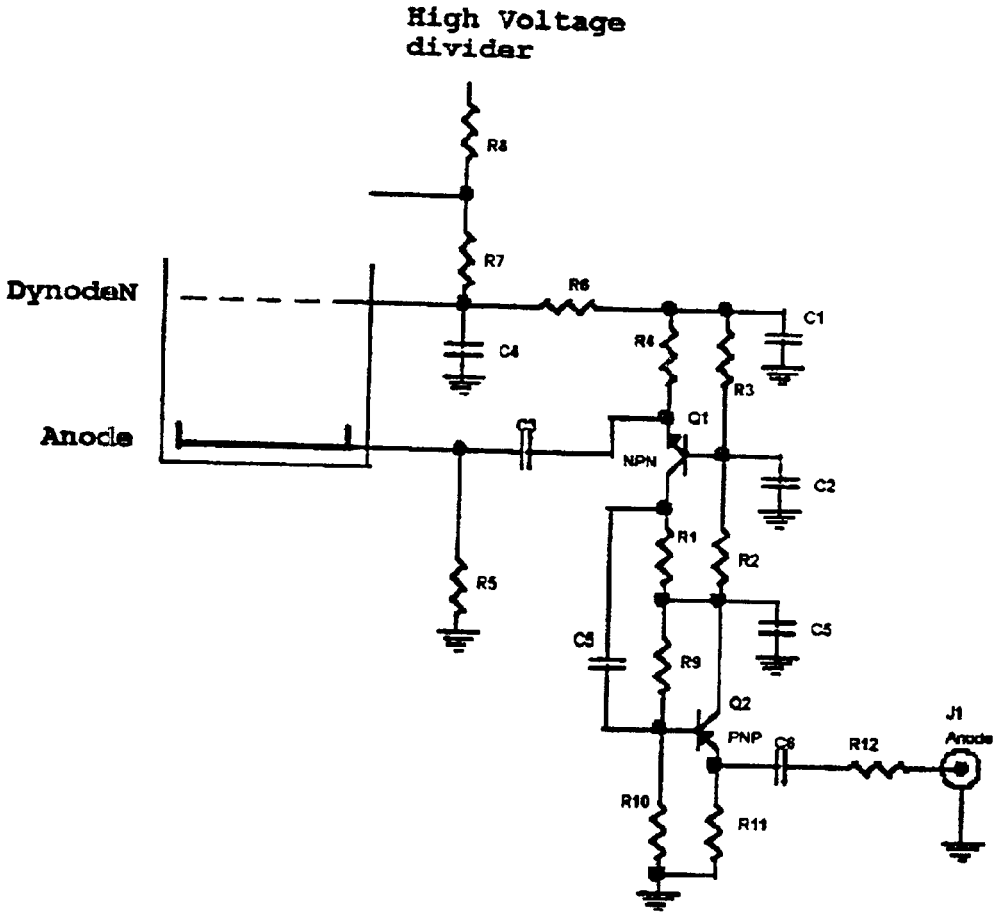
FIG. 5 shows an alternative amplifier for the present PMT Base.

FIG. 5 shows an alternative circuit design for the amplifier circuit that may be used in the present PMT Base. The alternative amplifying circuit comprises: transistors Q1 and Q2; resistors R1–R6 and R9–R12; and capacitors C1–C6. The circuit of FIG. 5 provides reduced effect of the PMT output capacitance, thus leading to sharper (more narrow) wave forms at the output J1. In each of FIGS. 5–7, resistors R7 and R8 are part of the circuitry the provides power and gain control for the dynode stages. The Anode provides the PMT output which becomes the input for the amplification circuit of FIG. 5.

Figure 6:
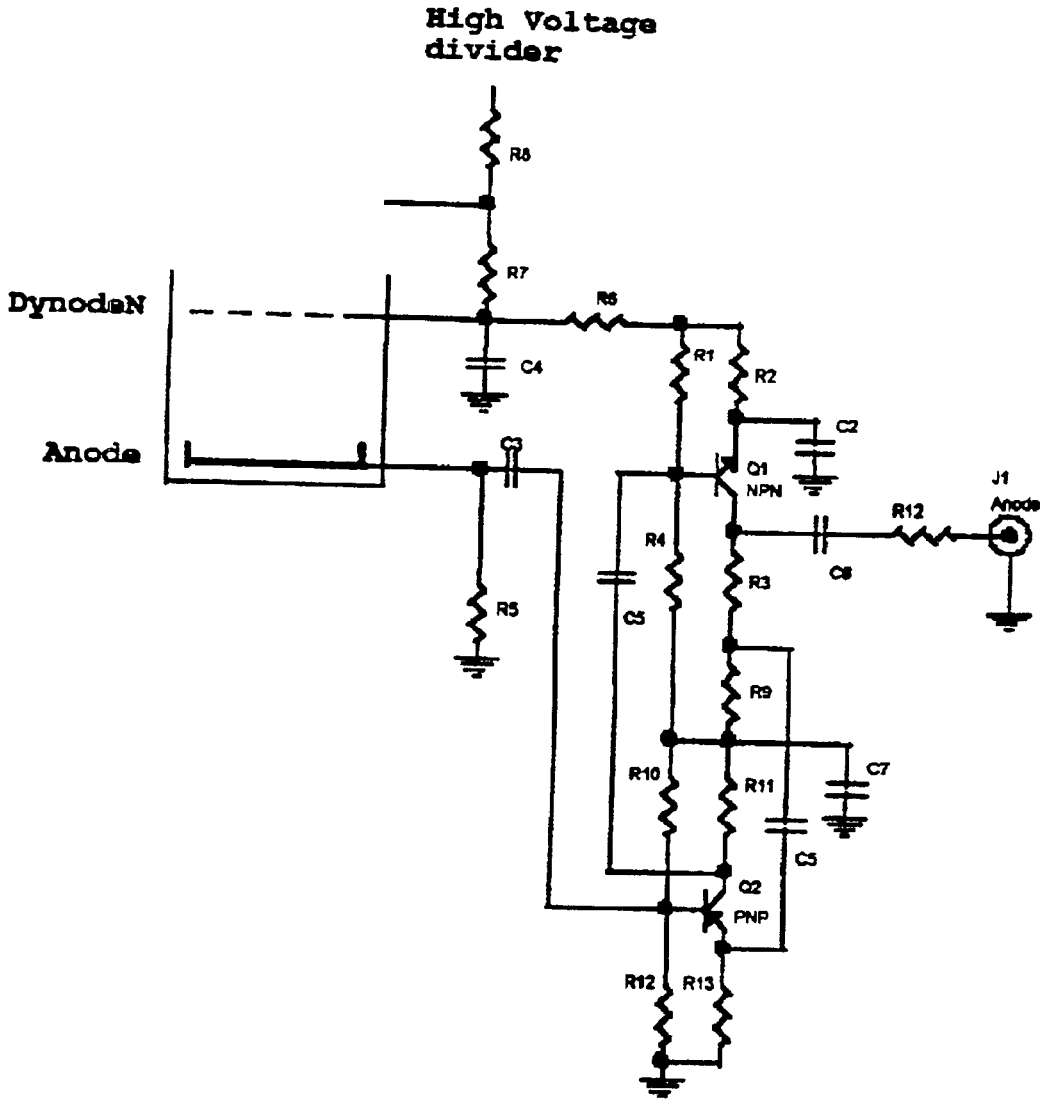
FIG. 6 shows another alternative amplifier for the present PMT Base.

FIG. 6 shows another alternative amplifying circuit that can be used in the present PMT Base. This alternative amplifying circuit comprises: transistors Q1 and Q2; resistors R1–R6 and R9–R13; and capacitors C1–C7. The amplified PMT signal is output at J1. This embodiment provides a two stage amplifier with adjustable gain. Again, the Anode provides the PMT output which becomes the input of the amplification circuit.

Figure 7:
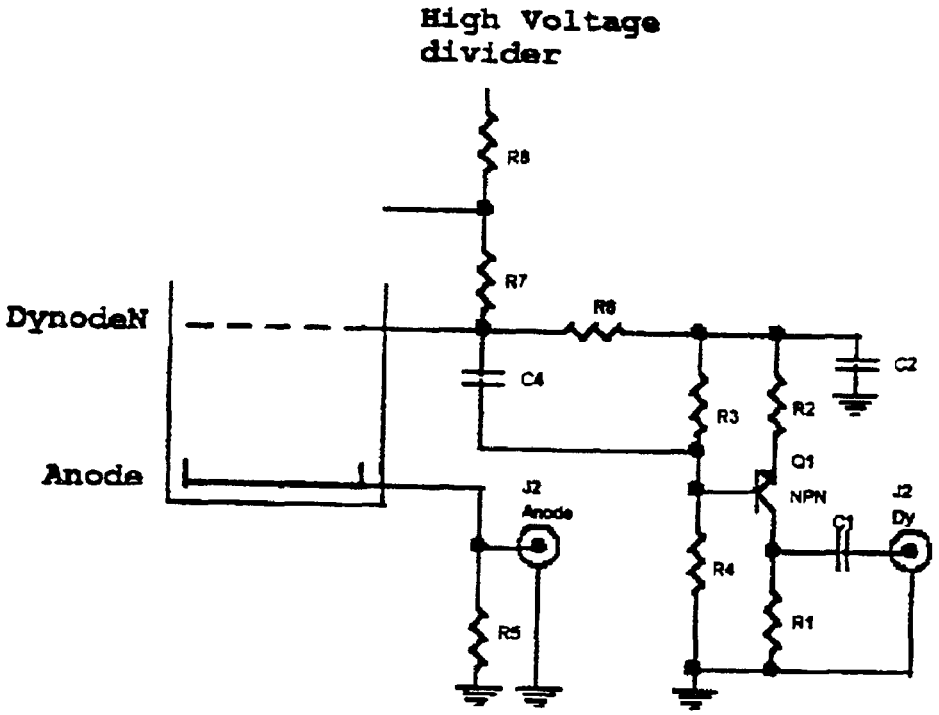
FIG. 7 shows another alternative amplifier for the present PMT Base.

FIG. 7 is another alternative amplifying circuit that can be used in the present PMT Base. In this embodiment, the output from the PMT comes from the last dynode stage DynodeN of the PMT to the amplifying circuit rather than from the Anode, as was the case in FIGS. 5 and 6. This embodiment still provides good power supply stability as well as amplification of the PMT output. The amplified PMT signal is output at J2 Dy. Each of the amplifying circuits shown in FIGS. 5–7 may be used as the amplifying circuit that is integrated with the circuitry for the dynode stages in the present PMT base.

Alternatively, the output signal from the PMT can come from both the Anode and the last Dynode stage. Such an embodiment provides further enhancement of pulse shaping of the subsequent electronic signal.

In the preferred embodiment, the PMT output signal is amplified by the amplifying circuit ten times, however this can be adjusted according to the application used. The present invention extends the life of Photo-Multiplier Tubes (PMT's) by allowing lower currents to be consumed by the dynodes within the PMT's. Given the fact that a PMT application may require 100,000 PMT's, extending the life of all of the PMT's will provide considerable monetary savings.

The foregoing description of the specific embodiments will so fully reveal the general nature of the invention that others can, by applying current knowledge, readily modify and/or adapt for various applications such specific embodiments without departing from the generic concept. Therefore, such adaptations and modifications should and are intended to be comprehended within the meaning and range of equivalents of the disclosed embodiments. It is to be understood that the phraseology of terminology employed herein is for the purpose of description and not of limitation.

I claim:

1. A photomultiplier tube base, comprising:

electronic circuitry that provides stable power and gain control for dynode stages of a photomultiplier tube (PMT); and an amplifying circuit for amplifying a PMT output signal and producing an amplified PMT signal;

wherein: the electronic circuitry and the amplifying circuit are integrated into one replaceable component that receives power from a PMT high voltage divider;

the PMT base provides pulse shape enhancement; and the PMT base can be electrically connected to the PMT.

2. The PMT base of claim 1 wherein, the PMT output signal travels from an anode of the PMT to the amplifying circuit.

3. The PMT base of claim 1 wherein, the PMT output signal travels from a dynode of the PMT to the amplifying circuit.

4. The PMT base of claim 1 wherein, the PMT output signal travels from both a dynode and an anode of the PMT to the amplifying circuit.

5. The PMT base of claim 1 wherein, the amplifying circuit comprises a one transistor amplifier.

6. The PMT base of claim 1 wherein, the amplifying circuit comprises a multi-stage amplifier.

7. A method of amplifying an output signal of a PMT, comprising the steps of:

integrating electronic circuitry, that provides stable power and gain control to dynode stages of the PMT, with an amplifying circuit, that amplifies the PMT output signal without disrupting the stable power, in a replaceable PMT base;

connecting the replaceable PMT base to the PMT wherein, connecting comprises electrically and mechanically connecting the PMT base to the PMT;

supplying power to the replaceable PMT base from a PMT high voltage divider; and outputting from the PMT base an amplified PMT output signal with enhanced pulse shaping.

8. The method of claim 7 wherein, the step of connecting further comprises electrically connecting an anode of the PMT to an input of the amplifying circuit so that the amplifying circuit receives the PMT output signal from the anode of the PMT.

9. The method of claim 7 wherein, the step of connecting further comprises, electrically connecting a dynode of the PMT to an input of the amplifying circuit so that the amplifying circuit receives the PMT output signal from the dynode of the PMT.

10. The method of claim 7 wherein, the step of connecting further comprises electrically connecting an anode and a dynode of the PMT to an input of the amplifying circuit so that the amplifying circuit receives the PMT output signal from both the anode and the dynode of the PMT.

11. The method of claim 7 wherein, the amplifying circuit in the integrating step comprises a one transistor amplifier.

12. The method of claim 7 wherein, the amplifying circuit in the integrating step comprises a multi-stage amplifier.

13. The method of claim 7 wherein, the amplifying circuit in the integrating step comprises an amplifier pulse shaper.

* * * * *